US007024011B1

(12) United States Patent
Hamacher et al.

(10) Patent No.: US 7,024,011 B1
(45) Date of Patent: Apr. 4, 2006

(54) HEARING AID WITH AN OSCILLATION DETECTOR, AND METHOD FOR DETECTING FEEDBACK IN A HEARING AID

(75) Inventors: Volkmar Hamacher, Wuerselen (DE); Georg-Erwin Arndt, Erlangen (DE); Tom Weidner, Nuremberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/567,894

(22) Filed: May 10, 2000

(30) Foreign Application Priority Data

May 12, 1999 (DE) ..... 199 22 132
May 12, 1999 (DE) ..... 199 22 133

(51) Int. Cl.
*H04R 25/00* (2006.01)

(52) U.S. Cl. ..... 381/320; 381/320; 381/93; 381/83

(58) Field of Classification Search ..... 381/312, 381/320, 321, 318, 83, 93, 95–96; 329/302, 329/306; 331/1 A, 1 R, 14, 17–18
See application file for complete search history.

(56) References Cited

U.S. PATENT DOCUMENTS 4,596,902 A * 6/1986 Gilman ..... 381/320
4,953,216 A 8/1990 Beer
5,170,434 A 12/1992 Anderson
5,396,560 A * 3/1995 Arcos et al. ..... 381/320
5,699,424 A * 12/1997 Hirano ..... 379/406.08
6,359,992 B1 * 3/2002 Preves et al. ..... 381/106

FOREIGN PATENT DOCUMENTS

DE OS 37 33 983 4/1989
WO WO 96/35314 11/1996

OTHER PUBLICATIONS

"Reducing Acoustic Feedback in Hearing Aids," Maxwell et al., IEEE Trans. on Speech Audio Processing, vol. 3, No. 4, Jul. 1995, pp. 304–313.

* cited by examiner

*Primary Examiner*—Curtis Kuntz
*Assistant Examiner*—Phylesha L. Dabney
(74) *Attorney, Agent, or Firm*—Schiff Hardin LLP

(57) ABSTRACT

In a hearing aid having an oscillation detector and a method for establishing the presence of oscillations in a hearing aid, sinusoidal input signals of the microphone can be detected, and so oscillations that are present can also be detected. To this end, the number of digitized sample values in consecutive periods of the input signal is determined, and a long-term average value $N_L$ and a short-term average value $N_K$ are formed from these numbers. When $N_L$ and $N_K$ are essentially identical, the presence of oscillations is detected.

21 Claims, 1 Drawing Sheet

HEARING AID WITH AN OSCILLATION DETECTOR, AND METHOD FOR DETECTING FEEDBACK IN A HEARING AID

BACKGROUND OF THE INVENTION

1. Field of the Invention

The present invention relates to hearing aid of the type having an oscillation detector and to a method for detecting oscillations, and thus feedback, in a hearing aid.

2. Description of the Prior Art

Methods for detecting oscillations and thus acoustic feedback in a hearing aid are known. As a rule, these methods are based on relatively complex algorithms or intensive frequency analyses (e.g. by means of Fourier transformation). This type of method of oscillation detection, as is known from European Application 0 656 737, for example, is relatively expensive in terms of hardware and is thus suitable for use in a hearing aid only in certain circumstances.

PCT Application WO 96/35314 teaches feedback suppression in a hearing aid in which the occurrence of feedback is detected. When feedback is discovered, the amplification is reduced in at least one frequency band and is left alone in all other frequency bands. To set the hearing aid definitively, a set of corresponding parameters is ultimately generated and stored. A disadvantage of this feedback suppression is that the occurrence of feedbacks is detected only during adjustment of the hearing aid, and feedback during the normal operation of the hearing aid are not detected and eliminated.

German OS 37 33 983 teaches a method for damping noise in contrast to speech, which also reduces the tendency for feedback. In this method the spectral distribution of detected sound signals is calculated by means of Fourier analysis in a number of frequency windows and is compared to predetermined limit values. The feedback suppression is based on a frequency transposition of the microphone signal, so that feedback does not even arise. This method, however, leads to a distortion of the input signal and thus impairs the sound quality of the hearing device.

German PS 39 27 765 teaches a hearing device with signal processing for improving the separation of voice signals relative to noise signals. Low-frequency noise signals are detected and damped. Acoustic feedback is not detected and suppressed.

The article "Reducing Acoustic Feedback in Hearing Aids", Maxwell et al. (IEEE Transaction on Speech and Audio Processing, Vol. 3, No. 4, July 1995), an adaptive filter is used, whose frequency response always corresponds to the inverse of the signal frequency response. When the input signal contains strong tonal components, a type of blocking filter thus develops, whose blocking band is located at the strongest (highest peak) frequency component of the microphone signal. When the energy of the microphone signal in the blocking range exceeds a threshold value, the output signal is the output signal of the blocking filter. Otherwise the microphone signal remains unchanged. A reliable feedback detection does not take place. This signal processing not only reduces feedback, but also all dominant spectral components of the input signal generally. Thus speech signals, which have a distinctive frequency structure, are also altered. This leads to a considerable impairment of the sound quality, as Maxwell et al. report.

Lastly, German PS 38 02 903 teaches a hearing device with a parallel circuit having several frequency selection channels. To suppress noise signals in regions in which these noise signals are not hidden by spectral components of speech, threshold switches with a control signal generator are located in each of these channels. The sum of the output signals of the Individual threshold switches is fed to the acoustic output converter. This circuit arrangement is also not suitable for suppressing feedback.

SUMMARY OF THE INVENTION

An object of the present invention is to provide a hearing aid having an oscillation detector and a method for detecting oscillations which can be executed in a hearing aid with a low outlay in terms of hardware.

The term hearing aid as used herein refers to a hearing aid of a size suitable to be worn at the ear, for instance a BTE (behind the ear) or ITE (in the ear) device, or an implantable hearing device.

The inventive hearing aid is distinguished by a particularly simply constructed oscillation detector, which requires only a small installation space and can be realized with a low outlay in terms of hardware.

The above object is achieved in accordance with the invention in a hearing aid having an oscillation detector with a period measuring element for determining the respective number of digitized sample values of consecutive periods of an input signal of the microphone of the hearing aid. The input signal is digitized by an A/D converter which can be connected to the oscillation detector upstream or integrated therewith.

The output values of the period measuring element pass through lower-level averaging elements in order to determine a long-term average value and a short-term average value, which are respectively related to a longer and a shorter time-span.

When it is established in a comparison element that the corresponding long-term and short-term average values are essentially identical, the presence of an oscillation and thus of acoustic feedback is detected.

In the inventive hearing aid, it is thus taken into consideration that oscillations that are to be detected usually occur in the form of sinusoidal input signals, and that in such sinusoidal input signals the long-term and short-term average values of the number of digitized sample values are essentially identical in successive signal periods. Here, sinusoidal signals can be differentiated from non-sinusoidal input signals.

The averaging elements of the inventive hearing aid can be low-pass filters. To reduce the hardware outlay, low-pass filters of the first order are used, one low-pass filter being driven with a longer time constant for determining the long-term average value, and another low-pass filter being driven with a shorter time constant for determining the short-term average value.

The oscillation detector also has an absolute-value element for correcting the operational sign of the difference between long-term and short-term average values, so that all evaluation values are present with a positive operational sign. In this way, a comparison to a likewise positive threshold value can be performed, without having to monitor a threshold range having both negative and positive values.

Finally, the oscillation detector has an additional averaging element, for instance another low-pass filter, in order to re-average the difference, which is determined in the comparison element between the long-term average value and the short-term average value, and to smooth it.

In the comparison of the long-term average value to the short-term average value, the comparison element of the oscillation detector that is used for this purpose preferably has an adjustable threshold, in order to be able to regulate the sensitivity of the oscillation detector. The threshold value can be set manually, or can be set automatically dependent on the environmental or noise situations detected.

The above object is also achieved in a method for oscillation detection in accordance with the invention wherein essentially sinusoidal input signals of the microphone are detected, since when these types of signals are present, oscillation and thus feedback usually can be assumed.

First, the number of digitized sample values in consecutive periods of the input signal of the microphone is determined. Next, it is determined whether the number of detected sample values changes in successive periods or is essentially identical. For this, a long-term average value $N_L$ and a short-term average $N_K$ of the number of sample values detected are formed.

Next, a difference of $N_L$ and $N_K$ is formed, the operational sign of the difference being corrected as warranted by forming the absolute value, and finally the difference value of $N_L$ and $N_K$ is smoothed.

In a subsequent comparison of the long-term average value to the short-term average value by difference formation, it can be determined whether both average values are essentially identical. If so, it can be assumed that the period durations of consecutive signal periods of the input signal are essentially identical, and thus an essentially sinusoidal signal is present, and so the presence of oscillation can be detected.

Overall, the inventive method makes it possible to detect the presence of substantially sinusoidal signals and thus of oscillation, with a small number of steps that are easy to realize in terms of hardware.

When oscillation has been detected a filtering element is set to corresponding blocking frequency and is activated to reduce the amplification and to suppress the feedback effect in a frequency-specific (narrowband) manner. As a result, an amplification reduction is set only when a feedback effect that must be suppressed is actually occurring. Furthermore, the noise suppression is concentrated by the activated filter element only on the frequency or frequency range in which the feedback is actually occurring. The remaining frequency ranges of the signal that is to be processed are not reduced in amplification.

Feedback effects, which are characterized by sinusoidal signals, are detected by the oscillation detector.

The oscillation detector also makes it possible for the inventive hearing aid to detect feedback effects that fluctuate in time and to determine the frequency that is suitable for suppression, and to set this frequency via actuation of the filter element. In this way, changing feedback situations can be detected and corrected.

In an embodiment, the hearing aid can have several filter elements (blocking filters, for instance notch filters). If, when a first filter element is activated, it is determined that the feedback effects persist, additional filter elements can be activated in order to achieve a reduction in amplification at other frequencies.

A general adjustability of the filtering characteristic of the filter elements (e.g. position and width of the blocking frequency range, degree of amplification reduction) makes it possible to adjust not only the frequency range of the amplification reduction, but also other suitable countermeasures (e.g. "width" and "depth" of the fatigue notch factor of the blocking filter) once the respective feedback effect has been detected by the oscillation detector. Given a particularly detailed classification of the types of feedback effects, precisely adapted countermeasures can be taken on the basis of a corresponding generation of the filter parameters, thereby achieving a particularly targeted and adapted feedback suppression, without this suppression being perceived by the user of the hearing aid, since only individual frequency ranges of the microphone signal that is to be processed are affected.

The reliability of the oscillation detector is increased when the level of the output signal Is determined by a level measuring unit and when feedback is detected only when an adjustable level threshold value is exceeded.

The oscillation detector, the filter elements and/or the level detector can be connected, driven and activated via a control unit. Thus, the control unit ensures that when feedback conditions are detected by the oscillation detector, the filter element is activated only if a signal level is present which is above an adjustable threshold and which is detected via the level detector.

The control unit can also be programmable and can take over additional functions of analysis of the signal that is to be processed, so that, on the basis of this signal analysis, a suitable threshold value is set in the level detector and is modified as warranted.

When feedback is detected and the filter elements are consequently activated appropriately, the desired frequency-specific amplification reduction In the signal processing path is realized. When feedback suppression is achieved, a feedback effect can no longer be detected.

It is thus not necessary to ascertain when the feedback effect, which may have occurred only temporarily due to specific environmental conditions, for example, is no longer present. The filter elements therefore can be activated for an adjustable period of time and then deactivated. A determination can then be made by the oscillation detector as to whether the initially detected feedback is still present, and a renewed filter activation can take place as warranted. A time-restricted filter activation keeps the filter from remaining on even though the causes for the feedback effect have disappeared due to changed environmental conditions.

A time-controlled activation of the filter elements can be accomplished via a time switch element, which can also be integrated into the control unit.

In an inventive method for operating a hearing aid, it is first ascertained, for the purpose of detecting feedback, whether an oscillating microphone signal is present, and then, if this is the case, a corresponding frequency-specific amplification reduction of the microphone signal to be processed is set. Frequency-specific and narrowband suppression of occurring feedback effects ensues, without affecting other frequency ranges of the microphone signal that is to be processed. The inventive method makes it possible to suppress feedback in a targeted manner that is particularly comfortable to the user, since the customary amplification potential remains in all unaffected frequency ranges.

According to an advantageous variant of the method, it is continuously determined whether feedback is occurring, whereupon appropriate measures for frequency-specific amplification reduction are taken, which adapt themselves to modifications of the detected feedback effects continuously overtime. By the constant observation of the noise situation, changes of feedback effects are also detected, and it is possible to react accordingly with suitable dynamic amplification reduction measures, so that the respective detected feedback is always suppressed precisely, and changes or disappearances of the feedback effects are noted.

In a further step it can be ascertained whether the output signal exceeds a specific level threshold value. The sharp increase of the signal level that occurs in a feedback situation is thus taken into consideration.

In a variant of the method it is additionally determined whether the signal level of the sinusoidal signal is above a specific threshold value. Only when an oscillating signal and an elevated level are present together is a feedback actually detected. If the respective level threshold value is not exceeded, a sinusoidal, largely monofrequency input signal can be present, without there being a feedback situation.

False detections thus can be reliably eliminated by taking the level criterion into account.

In the frequency-specific amplification reduction, the measure employed for suppressing the feedback can be optimally adapted, and by activating a suitable filtering characteristic, an adaptation of, for instance, the position and the size of the blocking frequency range and the degree of amplification reduction, so that a further improved feedback suppression can be achieved.

According to a further step, the amplification is reduced only for a specific time-span, and then the amplification reduction, automatically ceases, in order to discontinue the amplification reduction that was originally set and to switch it off when the sound situation changes and the originally detected feedback effect disappears. When feedback effects are detected again, filtering measures for amplification reduction can be reactivated again.

DESCRIPTION OF THE PREFERRED EMBODIMENTS

Figure 1:
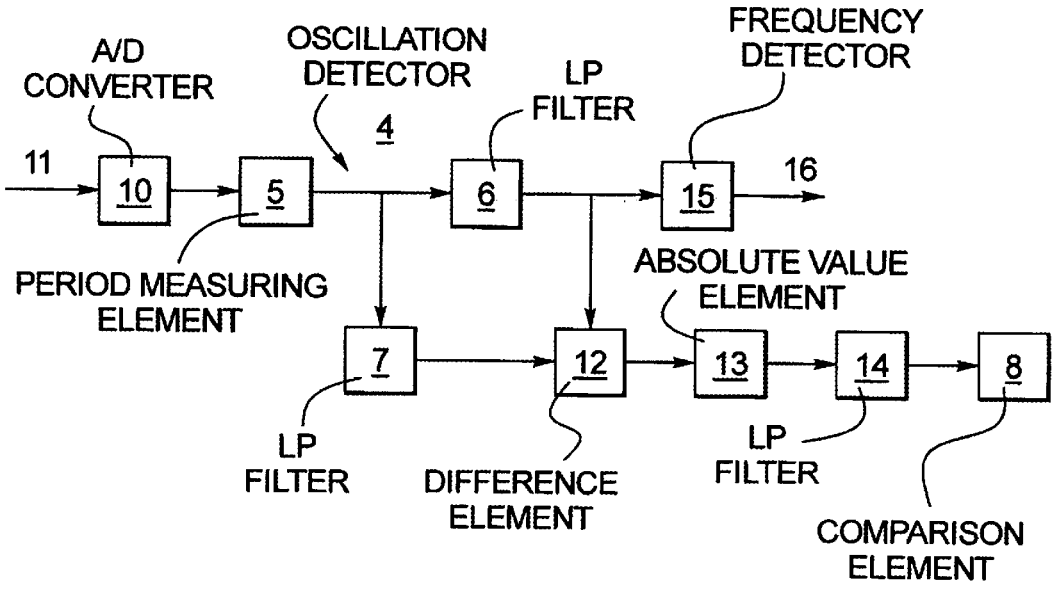
FIG. 1 is a block diagram of an embodiment of the inventive oscillation detector.

The functioning of the oscillation detector 4 will be explained based on the circuit diagram according to FIG. 1. An input signal 11 of a microphone 1 (cf. FIG. 2) is first digitized in an A/D converter 10 with a sampling rate of $f_s$. The A/D converter 10 can be integrated into the oscillation detector 4 or connected to it upstream. The digitized sample values of the A/D converter 10 are fed to a period measuring element 5, in order to determine the number of sample values respectively in consecutive periods of the input signal 11. Assuming a sampling rate $f_s$=20 kHz of the A/D converter 10, the period measuring element 5 could determine that the consecutive periods contain 4–6 sample values, for example.

This type of period measurement in the period measuring element 5 can be accomplished by determining and analyzing the zero crossings of the digitized sample values, for example. Thus, a change of operational sign and the direction of the change (from+ to –, or vice versa) can be detected. Altogether, the beginning and the end of a period of the input signal 11 (period duration) can be determined, and the number of digital sample values between the beginning and end of the period can be calculated.

By means of averaging elements that are connected to the period measuring element 5 downstream, namely low-pass filters 6,7, the long-term average value $N_L$ and the short-term average value $N_K$ of the number of sample values that were calculated by the period measuring element are determined in the respective signal periods of the input signal 11.

To reduce the hardware outlay, the two low-pass filters 6,7 are constructed as first-order recursive systems, which calculate the respective average values $N_L$ and $N_K$ in accordance with the following processing algorithm:

$$y_t = cy_{t-1} + (1-c)x_t$$

The recursion constant c lies in the range from 0 to 1 and determines the time constant of the low-pass filters 6,7. When the long-term average value $N_L$ is computed in the low-pass filter 6, a relatively high recursion constant (e.g. c=0.99) enters into its processing specification. When the short-term average value $N_K$ is calculated in the low-pass filter 7, its recursion constant is relatively small (e.g c=0.5). x stands for the input value (i.e. the number of sample values obtained per period), and y stands for the respective output value ($N_L$ or $N_K$) of the processing specification, this being specifically provided with the indices t for the respective sampling time interval.

In the difference element 12 a difference between $N_L$ and $N_K$ is formed, whose operational sign is corrected in an absolute value element 13, so that only positive values occur. Finally, an additional smoothing is performed by an additional averaging element here, another first-order low-pass filter 14. Next, the amount of the difference between $N_L$ and $N_K$ is evaluated in the comparison element 8. If this is below a certain adjustable threshold value, it is assumed that an essentially sinusoidal input signal 11 is present, and so the presence of oscillation can be assumed.

Given detection of the presence of such oscillation, the oscillation frequency 16 ($f_{osz}$) is computed in the frequency detector 15, namely as the product of the sampling rate $f_s$ and the reciprocal of the long-term average value $N_L$.

When oscillation has been detected, and a sampling rate $f_s$=20 kHz is present and the long-term average value $N_L$=5 has been calculated, this means that an oscillation frequency $f_{osz}$=4 kHz is present. This oscillation frequency $f_{osz}$ can be forwarded by the oscillation detector 4 to a control unit 20, so that suitable filter elements 17,18,19 can be activated, in order to neutralize the established oscillation, for instance by means of filters with notch action (cf. FIG. 2).

Figure 2:
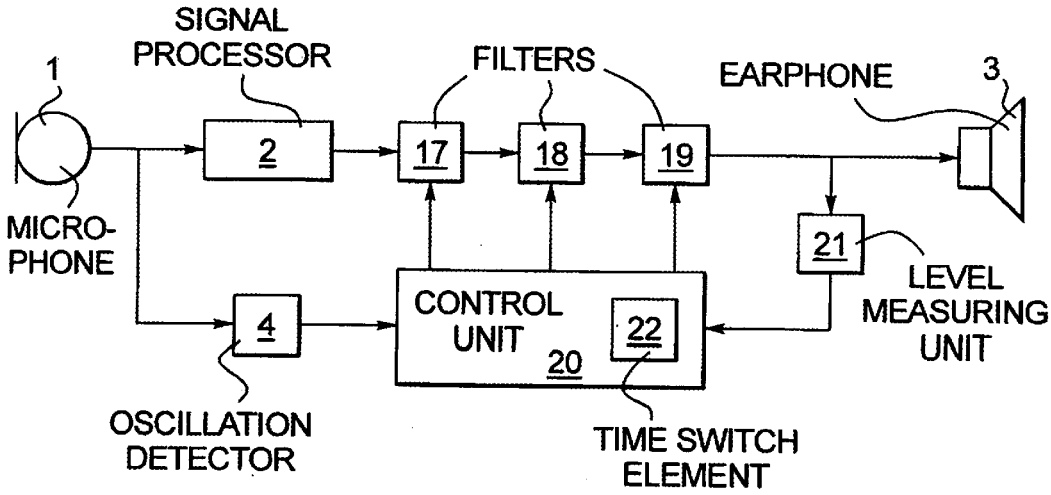
FIG. 2 is block diagram of a hearing aid with the inventive oscillation detector.

The basic circuit diagram illustrated In FIG. 2 shows a hearing aid having at least one microphone 1 as an acousto-electrical transducer, a signal processing stage 2, and an earphone 3 as an electro-acoustical transducer, with filter elements 17,18,19 for the frequency-specific reduction of amplification being provided in the signal processing path between the microphone 1 and earphone 3.

The filter elements 17,18,19 are set to respective computed blocking frequencies and activated when oscillating signals are detected by the oscillation detector 4 and feedback is detected.

If this is the case, it is reported by the oscillation detector 4 to the control element 20, and the adjustment (setting of the blocking frequency) of at least one of the filter elements 17, 18 or 19 is performed. If necessary, several filter elements 17,18,19 are also activated. Basically, an arbitrary number of filter elements 17,18,19 can be provided, in order to achieve a requisite comprehensive feedback suppression.

In a level detector 21, the level of the output signal is determined and this is communicated to the control element 20. The control unit 20 establishes the presence of feedback only if the presence of an oscillating signal is registered by the oscillation detector 4 and the level of the output signal— i.e. of the processed microphone signal—is determined by the level detector 21 to be in excess of the specific threshold value of the level detector 21.

Thus, the elevated level that often also occurs given feedback effects can be simultaneously taken into account, and a detection of high-monofrequency input signals in feedback-free situations is avoided.

Via the control unit 20, the filter elements 17,18 and 19 are not only activated but also are correspondingly adjusted with respect to their filtering characteristic (e.g. position and size of the block frequency range, degree of amplification reduction). To this end, the control unit can be programmable and can first set customary basic parameters of filter characteristics, in order to then perform a corresponding adjustment of the filter characteristics in accordance with a prescribed or self-learning program sequence if the feedback is not sufficiently suppressed.

Via the control unit 20, an analysis or classification of the feedback that is detected by the oscillation detector 4 can be accomplished and can influence or define the generation of the filter characteristic of the filter elements 17,18 and 19.

By means of a time switch element 22 that is integrated into the control element 20, given an originally detected feedback which would lead to an activation of the filter elements 17,18,19, this activation continues only for a limited time. After this, the activation of the filter elements 17,18,19 is automatically discontinued, and it is determined again via the oscillation detector 4 whether the originally occurring feedback is still present, or if a modified feedback (e.g. frequency shift) has occurred, which makes the renewed activation of the filter elements 17,18,19 appropriate, but with filtering characteristics of a different nature.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing aid comprising:

a microphone which receives an input acoustic signal and converts said input acoustic signal into an analog input signal;

an earphone which emits an acoustic output signal;

a signal path between said microphone and said earphone containing signal processing circuitry for processing said analog input signal; and an oscillation detector for detecting oscillations in said signal path as an indication of acoustic feedback in said signal path, said oscillation detector comprising an analog-to-digital converter supplied with said analog input signal for producing digitized sample values in consecutive periods of said analog input signal, a period measuring element supplied with said sample values for determining respective numbers of said sample values in said consecutive periods, a first averaging element for determining a long term average $N_L$ of said respective number of sample values, a second averaging element for determining a short-term average $N_K$ of said respective numbers, of sample values, a difference element for forming a difference between $N_L$ and $N_K$, an absolute value element for forming an absolute value of said difference, a third averaging element for smoothing said absolute value of said difference to obtain a smoothed difference value, and an analyzer element supplied with said smoothed difference value and detecting oscillations in said signal path when said smoothed difference value is substantially zero.

2. A hearing aid as claimed in claim 1 wherein each of said first, second and third averaging elements is a low-pass filter.

3. A hearing aid as claimed in claim 2 wherein each low-pass filter is a first-order low-pass filter.

4. A hearing aid as claimed in claim 1 wherein said analyzer element comprises a comparator for comparing said smoothed difference value to an adjustable threshold value.

5. A hearing aid as claimed in claim 1 wherein said analyzer element, upon detecting oscillations, emits an analyzer element output signal, and said hearing aid further comprising a control unit, supplied with said analyzer element output signal, and feedback suppressing circuitry connected in said signal path and to said control unit, said feedback suppressing circuitry being operated by said control unit, dependent on said analyzer element output signal, to suppress feedback in said signal path.

6. A hearing aid as claimed in claim 5 wherein said feedback suppressing circuitry comprises a filter element having an adjustable blocking frequency, said blocking frequency being set by said control unit dependent on said analyzer element output signal.

7. A hearing aid as claimed in claim 5 wherein said feedback suppressing circuitry comprises a plurality of filter elements, having respectively different filtering characteristics, including respectively different blocking frequencies, and wherein said control unit selects at least one of said filter elements for activation dependent on said analyzer element output signal.

8. A hearing aid as claimed in claim 7 wherein said respectively different filtering characteristics are each adjustable, and wherein said control unit adjusts the filtering characteristic of an activated filter element dependent on said analyzer element output signal.

9. A hearing aid as claimed in claim 5 wherein said control unit includes a timer and wherein said control unit activates said feedback suppressing circuitry only for a time span determined by said timer after said analyzer element output signal is received by said control unit.

10. A hearing aid as claimed in claim 5 wherein said signal processing circuitry supplies an output electrical signal to said earphone, and said hearing aid further comprising a level measuring unit which determines a level of said output electrical signal and enables said control unit only if said level of said output electrical signal exceeds a threshold value.

11. A hearing aid as claimed in claim 10 wherein said threshold value of said level detector is adjustable.

12. A method for detecting oscillations in a signal path in a hearing aid between a microphone and an earphone, comprising the steps of:

obtaining digitized sample values of an input signal from said microphone and determining respective numbers of said sample values in consecutive periods of said input signal;

determining a long-term average value $N_L$ of said respective numbers of sample values and determining a short-term average value $N_K$ of said respective numbers of sample values;

forming a difference between $N_L$ and $N_K$;

forming an absolute value of said difference;

smoothing said absolute value of said difference to obtain a smoothed difference; and identifying oscillations as being present in said signal path when said smoothed difference is substantially zero.

13. A method as claimed in claim 12 comprising analyzing an operational sign of said sample values when determining the respective numbers of said sample values in said consecutive periods.

14. A method as claimed in claim 12 wherein the step of identifying oscillations comprises comparing said smoothed difference to an adjustable threshold.

15. A method as claimed in claim 12 comprising the additional step of, when oscillations are identified, identifying a frequency of said oscillations as a product of a sampling rate at which said input signal was sampled to obtain said sample values, and the reciprocal of $N_L$.

16. A method as claimed in claim 12 comprising the additional step of, when oscillations are identified, making a frequency-specific reduction in amplification of said input signal from said microphone.

17. A method as claimed in claim 16 comprising continuously determining whether oscillations are present in said signal path and continuously making said frequency specific reduction in amplification as needed.

18. A method as claimed in claim 16 comprising providing a plurality of filter elements in said signal path having respectively different blocking frequencies, and making said frequency-specific reduction in amplification by activating at least one of said filter elements.

19. A method as claimed in claim 18 comprising providing said respective filter elements with respectively adjustable filtering characteristics, and making said frequency-specific reduction of amplification by selectively adjusting the respective filtering characteristics.

20. A method as claimed in claim 18 wherein said earphone is supplied with an output signal from said signal path, and comprising the additional step of identifying a level of said output signal and making said frequency-specific reduction of amplification only when said level of said output signal exceeds a selected value.

21. A method as claimed in claim 16 comprising making said frequency-specific reduction of amplification only for a selected time.

* * * * *